US008918981B2

(12) United States Patent
Seitel et al.

(10) Patent No.: US 8,918,981 B2
(45) Date of Patent: Dec. 30, 2014

(54) SYSTEM AND FIXTURE FOR CLOSING A FOLDABLE CAP

(75) Inventors: Norbert Seitel, Gillette, NJ (US); Michael Seitel, Randolph, NJ (US)

(73) Assignee: Norwalt Design, Inc., Randolph, NJ (US)

( * ) Notice: Subject to any disclaimer, the term of this patent is extended or adjusted under 35 U.S.C. 154(b) by 290 days.

(21) Appl. No.: 13/438,059

(22) Filed: Apr. 3, 2012

(65) Prior Publication Data

US 2012/0255154 A1 Oct. 11, 2012

Related U.S. Application Data

(60) Provisional application No. 61/472,793, filed on Apr. 7, 2011, provisional application No. 61/478,567, filed on Apr. 25, 2011.

(51) Int. Cl.
*B65B 7/26* (2006.01)
*B65B 7/28* (2006.01)

(52) U.S. Cl.
CPC ..... *B65B 7/2842* (2013.01)
USPC ..... 29/466; 29/430; 29/468; 53/375.5; 413/26

(58) Field of Classification Search
CPC ..... B23P 19/008; B23P 19/02; B23P 19/04; B23P 21/002; B23P 21/006; B21D 51/2653; B21D 51/44; B21D 51/28; B65B 7/26; B65B 7/20; B65B 7/08; B65B 7/2807
USPC ..... 29/466, 468, 559, 801, 281.1, 823, 710, 29/705, 773, 783, 790, 792, 795; 53/377.6; 413/26
See application file for complete search history.

(56) References Cited

U.S. PATENT DOCUMENTS

| | | | | |
|---|---|---|---|---|
| 2,653,745 | A * | 9/1953 | Huntar et al. | 53/377.6 |
| 3,255,519 | A * | 6/1966 | Zabroski et al. | 29/823 |
| 4,055,455 | A | 10/1977 | McDonald et al. | |
| 4,214,656 | A | 7/1980 | McDonald et al. | |
| 4,615,428 | A | 10/1986 | McDonald et al. | |
| 4,847,988 | A | 7/1989 | Eitzinger | |
| 4,878,575 | A | 11/1989 | McDonald et al. | |
| 5,070,599 | A | 12/1991 | Eitzinger et al. | |
| 5,934,496 | A | 8/1999 | Mogard et al. | |
| 7,322,458 | B1 | 1/2008 | McDonald et al. | |
| 2004/0222559 | A1 | 11/2004 | Gomes et al. | |

* cited by examiner

*Primary Examiner* — David Bryant
*Assistant Examiner* — Jun Yoo
(74) *Attorney, Agent, or Firm* — Hoffmann & Baron, LLP

(57) ABSTRACT

A fixture for holding a pivotally closable cap with a base connected to a cover by a foldable hinge during a closure operation. The fixture includes a U-shaped slide member having a back wall and a pair of side walls extending therefrom for accommodating the cap with the base and cover in an open condition. The side walls have distal extents, which extend beyond a transverse mid-line of the cover and prevent angular movement of the cover within the slide member.

10 Claims, 6 Drawing Sheets

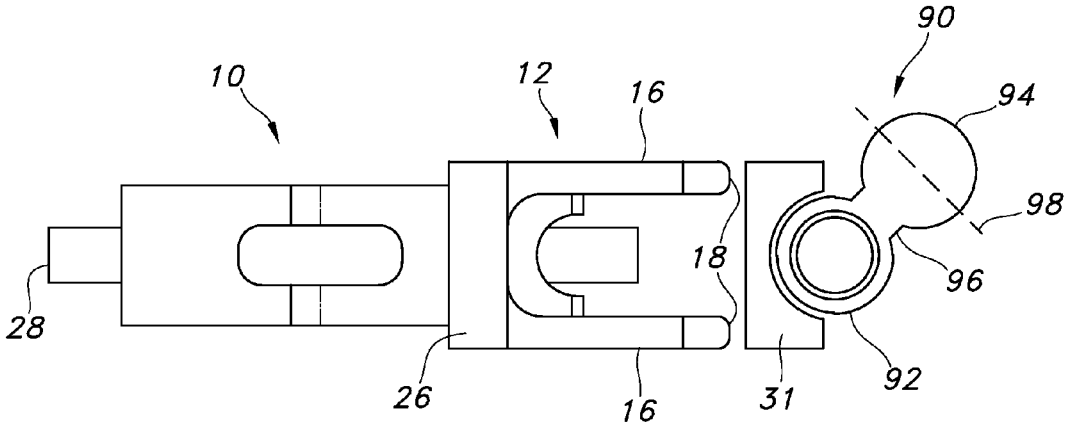
FIG. 1A
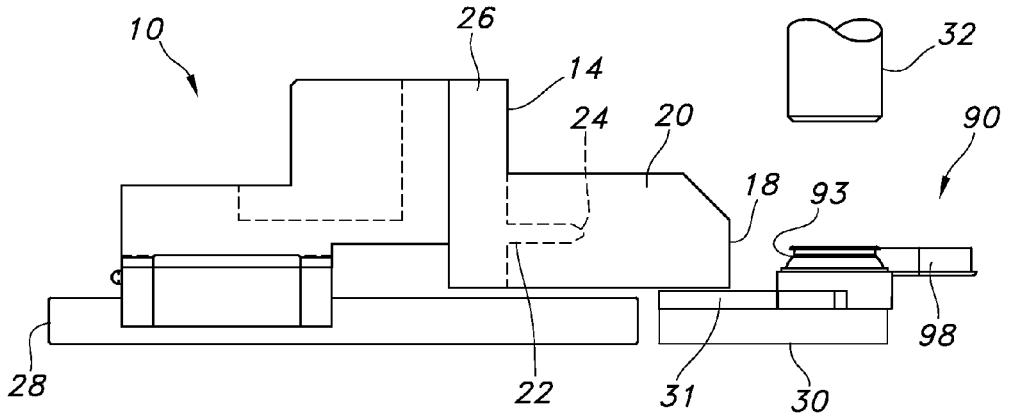
FIG. 1B
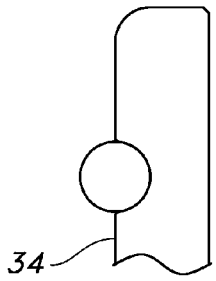

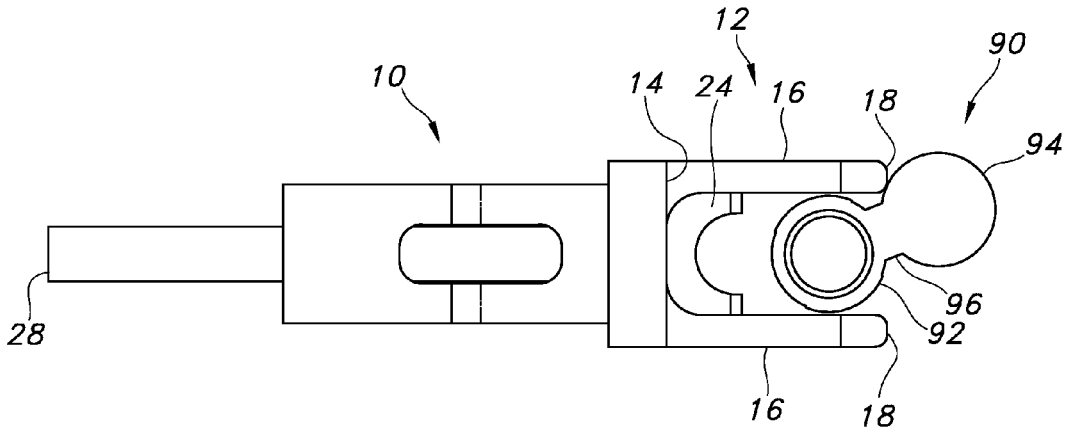
FIG. 2A
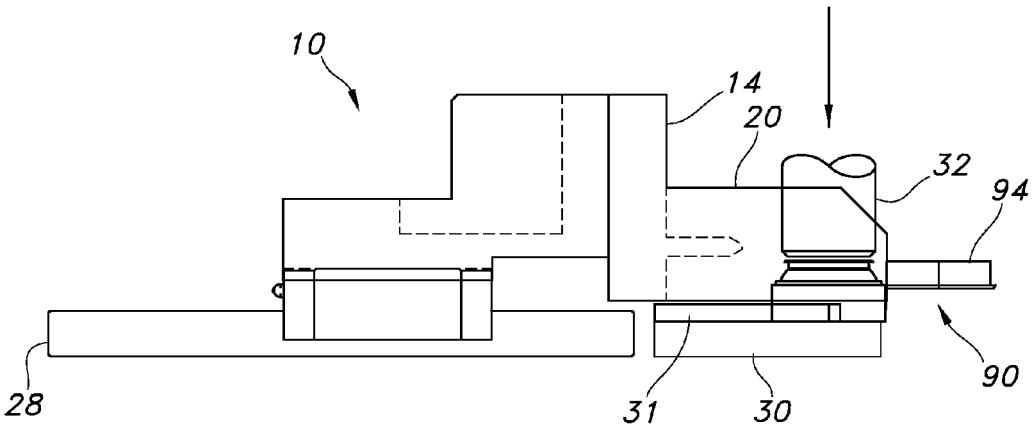
FIG. 2B
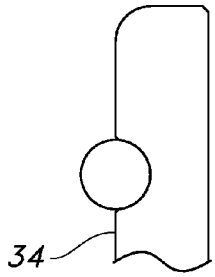

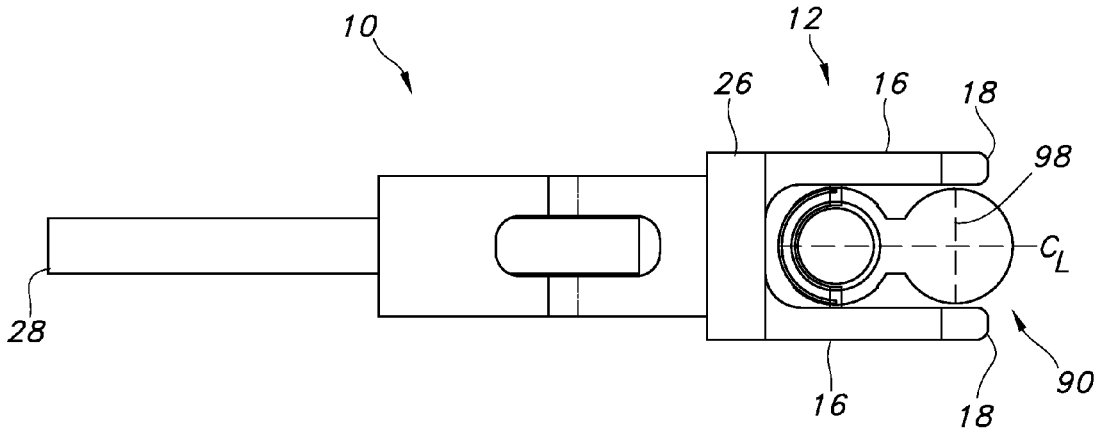
FIG. 3A
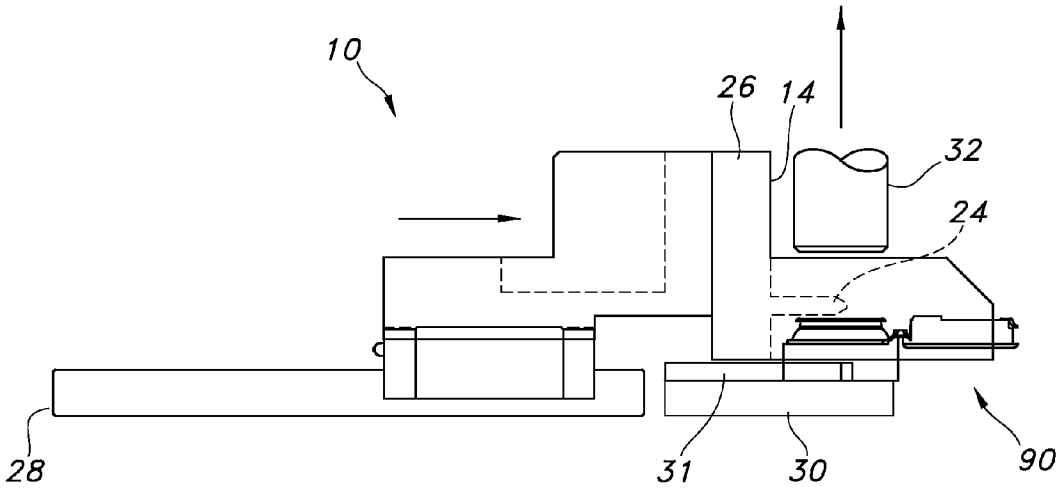
FIG. 3B
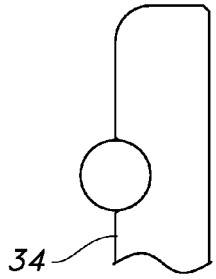

SYSTEM AND FIXTURE FOR CLOSING A FOLDABLE CAP

CROSS REFERENCE TO RELATED APPLICATIONS

This application claims priority to U.S. Provisional Patent Application No. 61/472,793, filed on Apr. 7, 2011, and U.S. Provisional Patent Application No. 61/478,567 filed on Apr. 25, 2011, the contents of which are incorporated herein by reference in its entirety.

FIELD OF THE INVENTION

The present invention relates generally to a method and system for foldably closing a cap having a base and cover connected by a hinge and, more particularly, to a fixture for supporting the cap during the folding operation.

BACKGROUND OF THE INVENTION

One piece molded reclosable caps are well known for use in covering a wide variety of containers. These closures or caps are typically a single piece molded flip-type part having a base and a cover connected by a hinge. The base is attached to the container and the cover is movable with respect to the base between a closed position and an open position permitting access to the contents of the container. Examples of such closures may be found in the cosmetics and food industries.

Closures such as these are typically produced by low cost injection molding. The parts are molded in large cavity molds for cost effectiveness. These molds produce the parts in an open condition. The ejected open parts must be subsequently closed before being applied to the container. Thus, the cover must be foldably closed over the base.

There exists in the art conventional automatic closing equipment designed to capture the molded part, orient it in the correct position, and close the cap by pivoting the cover onto the base. One such apparatus is shown and described in U.S. Pat. No. 4,947,988. As shown therein, the parts are progressively moved using a turntable. The turntable includes pockets to support the part during the closing operation.

Improvements which facilitate the accuracy and speed of such closure equipment are desirable.

SUMMARY OF THE INVENTION

The present invention provides a fixture for supporting a pivotally closable cap during a closure operation. The cap includes a base and a cover closably connected at a foldable hinge. The fixture includes a U-shaped slide member having a back wall and a pair of side walls. The U-shaped slide member accommodates the cap with the base and the cover in an open condition. The side walls of the slide member have distal extents, which extend beyond the transverse mid-line of the cover so as to prevent angular movement of the cap within the slide member.

It is also contemplated that the side walls of the slide member have upper extents which extend beyond the mid-line of the cover during folding.

The present invention also provides a closure system for closing a cap having a base and a cover connected to the base at a foldable hinge. The closure system includes a movable platform for supporting the cap. A retractable tamper is provided for engagement with the cap. A retractable closure tool is provided to fold the cover with respect to the base. A fixture is provided for supporting the cap on the platform. The fixture comprises a U-shaped slide member having a back wall and a pair of side walls for accommodating the cap with the base and the cover being in an open condition. The side walls include distal extents which extend beyond the transverse mid-line of the cover so as to prevent angular movement of the cap within the slide member. The retractable tamper is movable with respect to the platform from a forward position holding the base to the platform to a retracted position permitting the closure tool to effect folding of the cover onto the base and back towards the forward position closing the cover onto the base.

In a method aspect of the present invention, a method of closing a cap having a base and a cover connected by a foldable hinge is provided. The method includes providing a platform for supporting the cap in the open condition. A tamper is advanced to engage the base. A fixture is advanced to hold the cap. The tamper is retracted once the fixture holds the cap. A closure tool is advanced to fold the cover and once folded the fixture is retracted. The tamper is then advanced to engage the folded cover to secure the cover to the base. The fixture includes a U-shaped slide member that has a back wall and a pair of side walls. The U-shaped slide member accommodates the cap with the base portion of the cap closest to the back wall. The side walls have distal extents which extend beyond the transverse mid-line of the cover so as to prevent angular movement of the cap and rotational movement of the base within the slide member.

BRIEF DESCRIPTION OF THE DRAWINGS

FIGS. 1A and 1B are top and side views, respectively, of the closure system of the present invention in its first stage.

FIGS. 2A and 2B are top and views, respectively, of the closure system of the present invention in its second stage.

FIGS. 3A and 3B are top and side views, respectively, of the closure system of the present invention in the third stage.

DETAILED DESCRIPTION OF THE PREFERRED EMBODIMENT

Figure 4A:
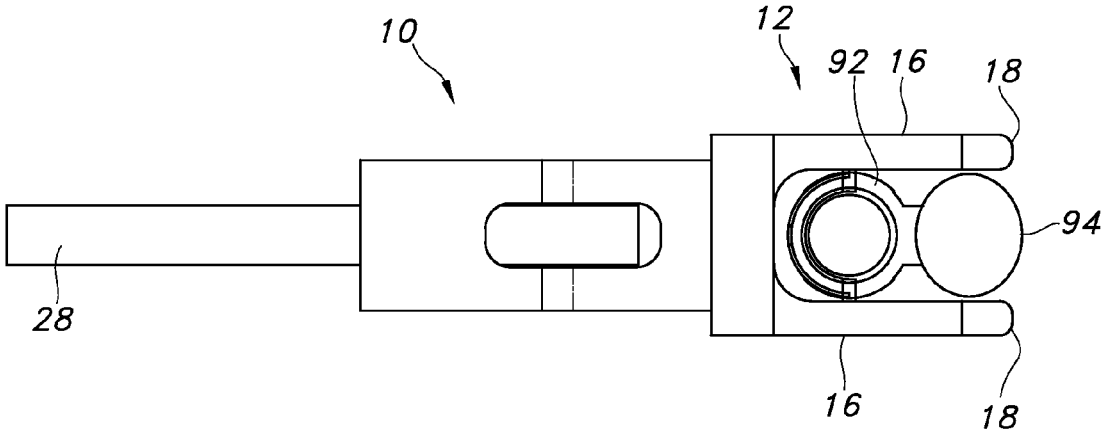
FIGS. 4A and 4B are top and side views, respectively, of the closure system of the present invention in the fourth stage.

The present invention provides a method and an apparatus for closing a molded flip-top cap. In conventional molding operations used to manufacture such caps, the cap is molded in the open condition with the cover and the base being generally coplanar and connected by a strip that serves as a hinge. In order to move the cap from an open condition to a closed condition, the cover must be folded or rotated about the hinge and onto the base and secured thereto. The cap may then be placed on the appropriate container for use.

The present invention includes a fixture used to hold a cap having a cover integrally connected by a hinge to a base during an operation to close the cover on the base. The cap typically has a circular shape; however, other configurations are within the contemplation of the present invention. For example, the fixture can be used with caps having other shapes, such as oval, rectangular or square, with only minor modifications that can easily be made by one of ordinary skill in the art. The present invention provides an efficient system for accurately aligning the open cap to permit accurate and efficient closure of the cap. The art has seen the use of machinery for closing such flip-type caps. One such machine is shown in U.S. Pat. No. 4,847,988 to Eitinger, entitled "Automatic Flip Top Cover Machine" and issued on Jul. 18, 1989, which is incorporated by reference herein for all purposes.

Referring now to the figures, the features of the present invention are described in more detail. FIGS. 1A-B through FIGS. 5A-B show top and side views, respectively, of the fixture 10 of the present invention in configurations corresponding to the sequential closing operation. The fixture 10 includes a U-shaped slide member 12 having a back wall 14 and a pair of side walls 16 extending from the back wall 14. The side walls 16 have distal extents 18 and upper extents 20. The back wall 14 can have an element 22 that can include a ledge 24 extending from the back wall 26. The fixture 10 slidably engages a rail structure 28 and provides movement of the U-shaped slide member 12 from a retractable position to an extended position. In preferred embodiments, the fixture 10 is operably connected to an actuating device (not shown).

FIGS. 1A through 5B also show a cap 90 with a base 92 and a cover 94 connected by a hinge 96 being in an open condition. When engaged by the fixture 10, the base 92 is disposed between the cover 94 and the back wall 14. The distal extents 18 of the side walls 16 extend beyond a transverse mid-line 98 of the cover 94 when the U-shaped slide member 12 is extended. When the cap 90 is positioned in the U-shaped slide member 12, the distal extents 18 of the side walls 16 prevent angular movement of said cover 94 and rotational movement of the base 92. The upper extents 20 of the side walls 16 extend beyond the mid-line 98 of the cover 94 when the cover 94 is pivotably folded onto the base 92. In preferred embodiments, the base 92 and the cover 94 are generally circular and the mid-line 98 is defined by the diameter of the cover 94.

After the cap 90 is molded, it is mounted on a movable platform 30 that positions the cap 90 in the fixture 10, where a tamper 32 is advanced to contact the cap 90 and ensure that it is properly positioned. The fixture 10 is then advanced and the ledge 24 holds the base 92 to the fixture 10. The ledge 24 extends from the back wall 14 and overlies the base 92. In some embodiments, the base 92 has an extended neck 93 and the ledge 24 has an arcuate shape and surroundingly engages the base around the neck 93. The ledge 24 holds the base 92 of the cap 90 down in place as the cover 94 is pivotably folded onto the base 92 by a closure tool 34. The tamper 32 is then advanced to push down on the cover 94 and secure it to the base 92, such as by snapping the cover onto the base.

The fixture 10 is movable with respect to the cap 90 from a retractable position to an extended position. The cap 90 is accommodated for non-angular and non-rotational movement within the U-shaped slide member 12 when the fixture 10 is in the extended position. In the extended position, the distal extents 18 of the side walls 16 extend beyond the transverse mid-line 98 of the cover 94.

The operation of the fixture 10 is illustrated in the sequential positions of the cap 90 with respect to the fixture 10 and the U-shaped slide member 12 in FIGS. 1A-B through 5A-B. In a preferred embodiment, the sequential steps of the stages may be achieved using a moveable platform 30 in the form of a rotatable turntable shown in FIG. 6. Other arrangements are also within the contemplation of the present invention.

FIGS. 1A and 1B show Stage I, wherein the cap 90 is mounted on the movable platform 30 in the open position. The tamper 32, the closure tool 34 and the U-shaped slide member 12 are in retracted positions. The platform 30 includes a pocket 31 which holds the base 92 of the cap during movement of the U-shaped slide member 12.

FIGS. 2A and 2B show Stage II, wherein the cap 90 is at an intermediate position with respect to the fixture 10, with the U-shaped slide member 12 partially extended. The cap 90 is disposed between the two side walls 16. The tamper 32 is advanced and contacts the base 92 of the cap 90 to ensure that it is properly positioned on the movable platform 30.

FIGS. 3A and 3B show Stage III, wherein the U-shaped slide member 12 is fully extended and the tamper 32 is retracted. The base 92 of the cap 90 is next to the back wall of the U-shaped slide member 12. The mid-line 98 of the cover 94 of the cap 90 is inside the distal extents 18 of the side walls 16, which causes the cap 90 to rotate so that the centerline, $C_L$, of the base 92 and cover 94 is parallel to the side walls 16. In this configuration, the base of the cap 90 is held down in the fixture 10 by the ledge 24.

Figure 4B:
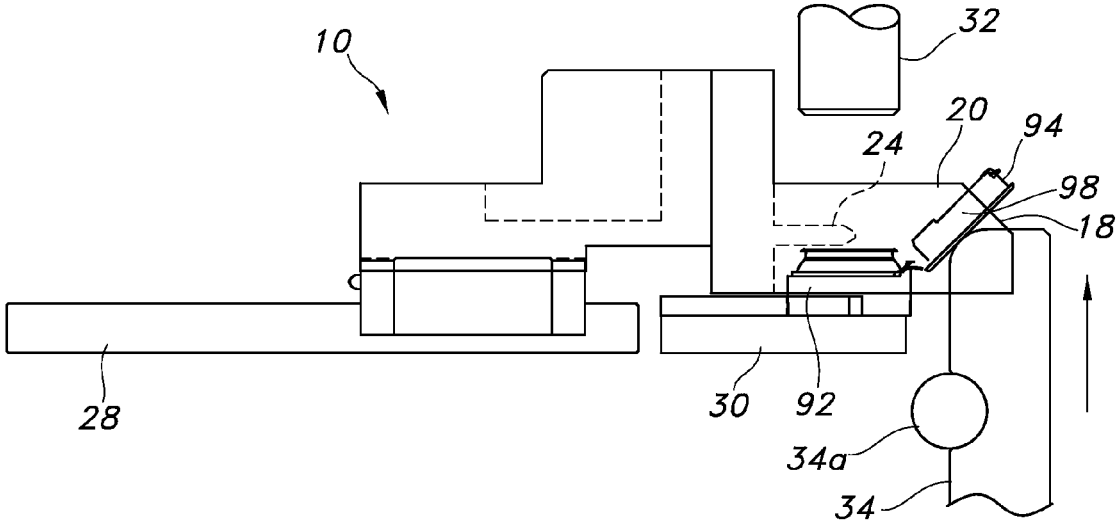

FIGS. 4A and 4B show Stage IV, wherein the closure tool 34 begins to advance and contacts the cover 94 of the cap 90, which causes it to pivotally rotate about the hinge 96 into a position above the base 92. As the closure tool 34 rotates the cover 94, the ledge 24 prevents the cap 90 from being dislodged from its position on the movable platform 30. A protruding portion 34*a* of the closing tool 34 moves the cap 90 to a position over the base 92. The upper extents 20 of the sidewalls 16 have a height which extends beyond the mid-line 98 of the cover 94, so as to further prevent angular movement of the cap in the fixture 12 during closure.

Figure 5A:
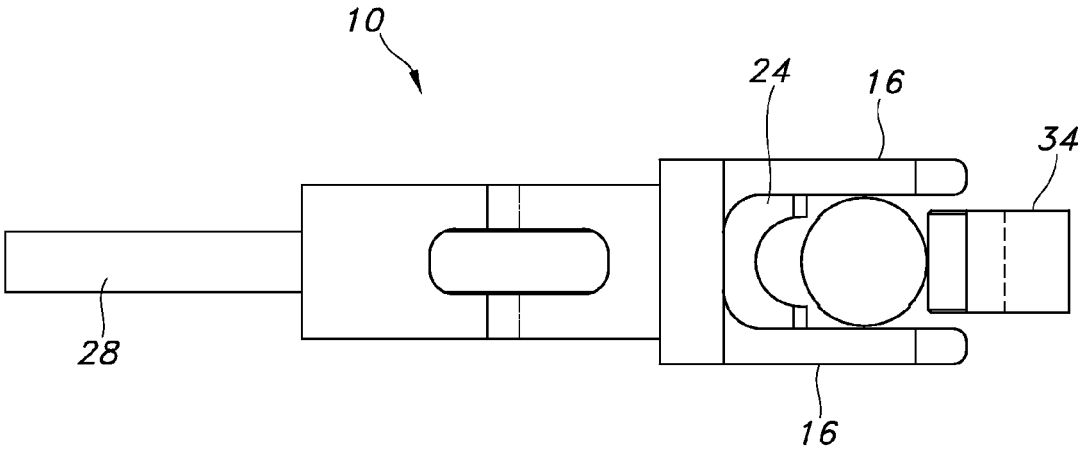
FIGS. 5A and 5B are top and side views, respectively, of the closure system of the present invention in the fifth stage.
Figure 5B:
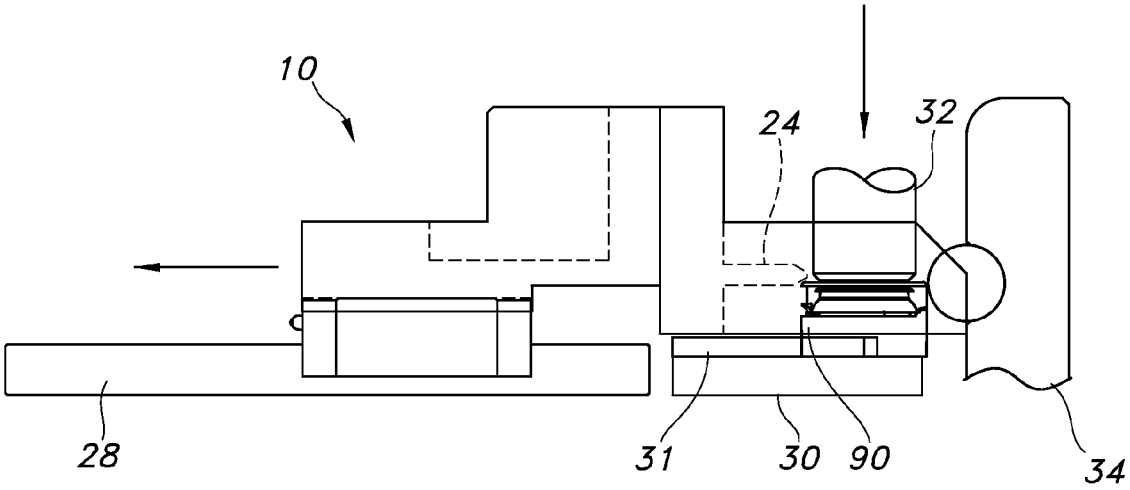
Figure 6:
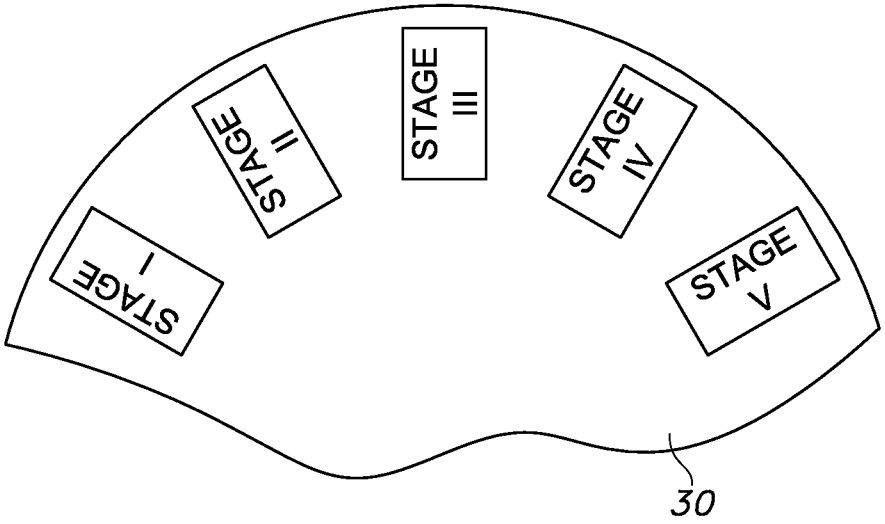
FIG. 6 shows the five stages of the closure operation using the fixture of the present invention.

FIGS. 5A and 5B show Stage IV, wherein the closure tool 34 has been fully advanced and the U-shaped slide member 12 is partially retracted so that the base 92 is still between the side walls 16. The tamper 32 is then advanced to secure the cover 94 to the base 92 of the cap 90 by snap-fit. After the cover 94 is secured, the tamper 32 and closure tool 34 are retracted to release the cap 90. The U-shaped slide member 12 is then fully retracted and the movable platform 30 moves the closed cap 90 to the next location in the process.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

What is claimed is:

1. A fixture for holding a pivotally closable cap during a closure operation, said cap including a base and cover closably connected at a foldable hinge, said fixture comprising:

a U-shaped slide member having a back wall and a pair of side walls extending from said back wall, for accommodating said cap with said base and said cover being in an open condition;

said side walls having distal extents which extend beyond a transverse mid-line of said cover so as to prevent angular movement of said cover within said slide member;

wherein said slide member is movable with respect to said cap from a retractable position to an extended position and wherein said cap is accommodated for such non-angular movement within said U-shaped slide member in said extended position;

wherein said distal extents of said side walls extend beyond said transverse mid-line of said cover in said extended position.

2. A fixture according to claim 1, wherein said side walls have upper extents which extend beyond said mid-line of said cover during folding.

3. A fixture according to claim 2, wherein said base and said cover of said cap are generally circular and wherein said mid-line is defined by the diameter of said cap.

4. A fixture according to claim 1, wherein said back wall of said slide member includes an element for holding said base of said cap.

5. A fixture according to claim 4, wherein said element includes a ledge extending from said back wall for overlying said base.

6. A closure system for closing a cap having a base and a cover connected to said base at a foldable hinge, said closure system comprising:

a movable platform for supporting said cap;

a retractable tamper for engagement with cap;

a retractable closure tool for folding said cover; and a fixture for holding said cap on the platform;

said fixture comprising:

a U-shaped slide member having a back wall and a pair of side walls extending from said back wall, for accommodating said cap with said base and said cover being in an open condition;

said side walls having distal extents which extend beyond a transverse mid-line of said cover so as to prevent angular movement of said cover within said slide member;

said retractable tamper being movable with respect to said platform from a forward position holding said base to said platform, to a retracted position permitting said closure tool to effect folding of said cover onto said base and back to said forward position closing said cover onto said base.

7. A closure system according to claim 6, wherein said side walls have upper extents which extend beyond said mid-line of said cover during folding.

8. A closure system according to claim 7, wherein said slide member is movable with respect to said cap from a retractable position to an extended position, and wherein said cap is accommodated for said non-angular movement within said U-shaped slide member in said extended position.

9. A closure system according to claim 8, wherein said distal extents of said side walls extend beyond said transverse mid-line of said cover in said extended position.

10. A closure system according to claim 9, wherein said tamper is retractable away from said base upon movement of said slide member to said extended position.

* * * * *